US005100569A

United States Patent [19]

Nalewajek et al.

[11] Patent Number: 5,100,569

[45] Date of Patent: Mar. 31, 1992

[54] POLYOXYALKYLENE GLYCOL REFRIGERATION LUBRICANTS HAVING PENDANT, NON-TERMINAL PERFLUOROALKYL GROUPS

[75] Inventors: David Nalewajek, West Seneca; Richard E. Eibeck, Orchard Park; Raymond H. Thomas, North Tonawanda, all of N.Y.

[73] Assignee: Allied-Signal Inc., Morristown, N.J.

[21] Appl. No.: 621,163

[22] Filed: Nov. 30, 1990

[51] Int. Cl.[5] ..... C10M 107/38

[52] U.S. Cl. ..... 252/54; 252/52 A; 252/68

[58] Field of Search ..... 252/54, 52 A, 58, 68

[56] References Cited

U.S. PATENT DOCUMENTS

| | | | |
|---|---|---|---|
| 2,723,999 | 11/1955 | Cowen et al. | 260/615 |
| 3,483,129 | 12/1969 | Dolle et al. | 252/49.9 |
| 4,052,277 | 10/1977 | Martini | 204/158 |
| 4,079,084 | 3/1978 | Houghton | 260/615 |
| 4,118,398 | 10/1978 | Martini | 260/340.6 |
| 4,267,064 | 5/1981 | Sasaki et al. | 252/52 |
| 4,359,394 | 11/1982 | Gainer et al. | 252/54 |
| 4,379,768 | 4/1983 | Yamabe et al. | 260/544 F |
| 4,428,854 | 1/1984 | Enjo et al. | 252/69 |
| 4,431,557 | 2/1984 | Shimizu et al. | 252/62 A |
| 4,443,349 | 4/1984 | Snyder et al. | 252/49.9 |
| 4,454,052 | 6/1984 | Shoji et al. | 252/68 |
| 4,497,720 | 2/1985 | Moriga et al. | 252/52 A |
| 4,675,452 | 6/1987 | Lagow et al. | 568/601 |
| 4,699,969 | 10/1987 | Re et al. | 528/70 |
| 4,755,316 | 7/1988 | Magid et al. | 252/68 |
| 4,758,366 | 7/1988 | Parekh | 252/68 |
| 4,827,042 | 5/1989 | Lagow et al. | 568/603 |
| 4,898,991 | 2/1990 | Huang | 568/615 |
| 4,931,199 | 6/1990 | Bierschenk | 252/68 |
| 4,944,890 | 7/1990 | Deeb et al. | 252/54 |
| 4,946,611 | 8/1990 | Kaneko | 252/49.6 |
| 4,948,525 | 8/1990 | Sasaki et al. | 252/54 |
| 4,975,212 | 12/1990 | Thomas | 252/58 |

FOREIGN PATENT DOCUMENTS

| | | |
|---|---|---|
| 577327 | 6/1959 | Canada . |
| 2750980 | 5/1979 | Fed. Rep. of Germany . |
| 51795 | 3/1982 | Japan . |
| 96684 | 5/1985 | Japan . |
| 146996 | 6/1987 | Japan . |
| 118598 | 5/1989 | Japan . |
| 8702992 | 5/1987 | PCT Int'l Appl. . |
| 8702993 | 5/1987 | PCT Int'l Appl. . |
| 8800963 | 2/1988 | PCT Int'l Appl. . |
| 8901928 | 3/1989 | PCT Int'l Appl. . |
| 1087283 | 10/1967 | United Kingdom . |
| 1354138 | 5/1974 | United Kingdom . |

OTHER PUBLICATIONS

"Lubricants in Refrigerant Systems", Chapter 32, 1980 ASHRAE Systems Handbook, pp. 32.1–32.24.

Downing—Fluorocarbon Refrigerant Handbook, pp. 13–14.

Kruse et al., "Fundamentals of Lubrication in Refrigerating Systems and Heat Pumps", ASHRAE Transactions 90(2B) 763 (1984).

Spauschus, "Evaluation of Lubricants for Refrigeration and Air-Conditioned Compressors", Research Disclosure 17463.

Sanvordenker et al., "A Review of Synthetic Oils for Refrigeration Use".

ASHRAE Symposium, Jun. 29, 1972.

McBee et al., "The Preparation and Properties of 3,3,3-Trifluoro-1,2-epoxypropane".

Trischler, "Preparation of Fluorine-Containing Polyethers," J. of Polymer Science 5(A-1), 2313 (1967).

Carre, Tribology Transactions, 31 (4), 437 (1987).

Carre, 1988 Report.

*Primary Examiner*—Prince Willis, Jr.

*Assistant Examiner*—Thomas Steinberg

*Attorney, Agent, or Firm*—Melanie L. Brown; Jay P. Friedenson

[57] ABSTRACT

The present invention provides a composition for use in refrigeration and air-conditioning comprising: (a) at least one refrigerant selected from the group consisting of hydrofluorocarbon, hydrochlorofluorocarbon, fluorocarbon, and chlorofluorocarbon; and (b) a sufficient amount to provide lubrication of at least one polyoxyalkylene glycol. The polyoxyalkylene glycol has at least one pendant non-terminal perfluorinated alkyl group on its hydrocarbon polymer backbone. The polyoxyalkylene glycol is terminated with a group selected from the group consisting of hydrogen, alkyl, and fluoroalkyl. The polyoxyalkylene glycol has a molecular weight of about 300 to about 4,000 and a viscosity of about 5 to about 300 centistokes at 37° C. The polyoxyalkylene glycol is miscible in combination with the refrigerant in the range between about −40° C. and at least about +20° C.

23 Claims, No Drawings

POLYOXYALKYLENE GLYCOL REFRIGERATION LUBRICANTS HAVING PENDANT, NON-TERMINAL PERFLUOROALKYL GROUPS

CROSS-REFERENCE TO RELATED APPLICATION

Commonly assigned allowed U.S. Pat. No. 4,975,212 filed Dec. 27, 1988, to issue on Dec. 4, 1990, Claims a lubricating composition comprising a polyoxyalkylene glycol having a cap of a fluorinated alkyl group on at least one end thereof wherein the polyoxyalkylene glycol is prepared from copolymers of ethylene and propylene oxides, ethylene and butylene oxides, or propylene and butylene oxides.

BACKGROUND OF THE INVENTION

The present invention relates to refrigeration lubricants having a partially fluorinated polymer backbone. More particularly, the present invention relates to refrigeration lubricants for use with tetrafluoroethane and preferably, 1,1,1,2-tetrafluoroethane (known in the art as R134a). R134a is a refrigerant which may replace dichlorodifluoromethane (known in the art as R12) in many applications because environmental concerns over the use of R12 exist.

R134a has been mentioned as a possible replacement for R12 because concern over potential depletion of the ozone layer exists. R12 is used in closed loop refrigeration systems; many of these systems are automotive air-conditioning systems. R134a has properties similar to those of R12 so that it is possible to substitute R134a for R12 with minimal changes in equipment being required. The symmetrical isomer of R134a is R134 (1,1,2,2-tetrafluoroethane); the isomer is also similar in properties and may also be used. Consequently, it should be understood that in the following discussion, "tetrafluoroethane" will refer to both R134 and R134a.

A unique problem arises in such a substitution. Refrigeration systems which use R-12 generally use mineral oils to lubricate the compressor; the present discussion does not apply to absorption refrigeration equipment. See for example the discussion in Chapter 32 of the 1980 ASHRAE Systems Handbook. R-12 is completely miscible with such oils throughout the entire range of refrigeration system temperatures which may range from about −45.6° to 65.6° C. Consequently, oil which dissolves in the refrigerant travels around the refrigeration loop and generally returns with the refrigerant to the compressor. The oil does not separate during condensation, although it may accumulate because low temperatures exist when the refrigerant is evaporated. At the same time, the oil which lubricates the compressor contains some refrigerant which may affect its lubricating property.

It is known in the industry that chlorodifluoromethane (known in the art as R22) and monochlorodifluoromethane/1-chloro-1,1,2,2,2-pentafluoroe thane (known in the art as R502) are not completely miscible in common refrigeration oils. See Downing, FLUOROCARBONS REFRIGERANT HANDBOOK, p. 13. A solution to this problem has been the use of alkylated benzene oils. Such oils are immiscible in R134a and are not useful therewith. This problem is most severe at low temperatures when a separated oil layer would have a very high viscosity. Problems of oil returning to the compressor would be severe.

R134a is not miscible with mineral oils; consequently, different lubricants will be required for use with R134a. However, as mentioned above, no changes to equipment should be necessary when the refrigerant substitution is made. If the lubricant separates from the refrigerant, it is expected that serious operating problems could result. For example, the compressor could be inadequately lubricated if refrigerant replaces the lubricant. Significant problems in other equipment also could result if a lubricant phase separates from the refrigerant during condensation, expansion, or evaporation. These problems are expected to be most serious in automotive air-conditioning systems because the compressors are not separately lubricated and a mixture of refrigerant and lubricant circulates throughout the entire system.

These problems have been recognized generally in the refrigeration art. Two recent publications by ASHRAE suggest that separation of lubricants and refrigerants presents problems, although no mention is made of R134a. These articles are Kruse et al., "Fundamentals of Lubrication in Refrigeration Systems and Heat Pumps," *ASHRAE TRANSACTIONS* 90(2B), 763 (1984) and Spauschus, "Evaluation of Lubricants for Refrigeration and Air-Conditioning Compressors," ibid, 784.

The following discussion will be more readily understood if the mutual solubility of refrigerants and various lubricating oils is considered in general with specific reference to R134a. Small amounts of lubricants may be soluble in R134a over a wide range of temperatures, but as the concentration of the lubricant increases, the temperature range over which complete miscibility occurs, i.e., only one liquid phase is present, narrows substantially. For any composition, two consolute temperatures, i.e., a lower and a higher temperature, may exist. That is, a relatively low temperature below which two distinct liquid phases are present and above which the two phases become miscible and a higher temperature at which the single phase disappears and two phases appear again may exist. A diagram of such a system for R502 refrigerant is shown as FIG. 2 in the Kruse et al. paper mentioned above. A range of temperatures where one phase is present exists and while it would be desirable that a refrigeration system operate within such a range, it has been found that for typical compositions, the miscible range of lubricants with R134a is not wide enough to encompass the typical refrigeration temperatures.

Disclosures which are concerned with the choice of lubricants when R134a is used as a refrigerant exist. Polyalkylene glycols were suggested to be used in Research Disclosure 17483, October 1978 by DuPont. Specific reference was made to such oils produced by Union Carbide Corporation under the trade names "ULCON" (sic) LB-165 and UCON 525. It is stated that these oils are miscible in all proportions with R134a at temperatures at least as low as −50° C. It is believed that "ULCON" (sic) LB-165 and UCON 525 are polyoxypropylene glycols which have a hydroxy group at one end of each molecule and a n-butyl group at the other end.

The use of synthetic oils for refrigeration systems including polyoxyalkylene glycols is discussed by Sanvordenker et al. in a paper given at an ASHRAE Symposium, June 29, 1972. The authors make the point that polyglycols should properly be called ethers and esters rather than glycols because the terminal hydroxyl groups are bound by ester or ether groups. It is stated that this substitution makes them suitable for lubrication.

U.S. Pat. No. 4,428,854 discloses the use of R134a as an absorption refrigerant where organic solvents are used as absorbing agents. An example is tetraethylene glycol dimethyl ether. A related patent U.S. Pat. No. 4,454,052 also discloses polyethylene glycol methyl ether used as an absorbent along with certain stabilizing materials for refrigerants such as 134a.

Japanese Patent Publication 96684 dated May 30, 1985 addresses the stability problems of refrigerants. The reference teaches that perfluoro ether oligomers are one class of useful lubrication oils.

U.S. Pat. No. 4,267,064 also recommends the use of polyglycol oils, particularly for rotary compressors. It is indicated that viscosities in the range of 25-50 centistokes (CS) at 98.9° C. are needed plus a viscosity index greater than 150. Many refrigerants are mentioned but not tetrafluoroethane.

Japanese published application No. 51795 of 1982 relates to antioxidants and corrosion inhibitors for use with various polyether type synthetic oils. The tests were carried out with R-12, which does not exhibit the immiscible character of R134a.

Japanese published patent application 96,684 published May 30, 1985 addresses the stability problems of refrigerants. The reference mentions 12 refrigerants including tetrafluoroethane. The reference also teaches six classes of lubricants including perfluoro ether oligomer, fluorinated silicone, fluorinated oxethane, chlorotrifluoro ethylene polymer, fluorinated polyphenyl ether, and perfluoroamine.

U.S. Pat. No. 4,431,557 relates to additives used in synthetic oils. Many refrigerants are mentioned, but not tetrafluoroethane, and the patentees gave no indication of concern for miscibility of the refrigerants and the lubricants.

Commonly assigned U.S. Pat. No. 4,755,316 teaches a compression refrigeration composition. The refrigerant is tetrafluoroethane while the lubricant is at least one polyoxyalkylene glycol which is at least difunctional with respect to hydroxyl groups, has a molecular weight between 300 and 2,000, has a viscosity of about 25–150 centistokes at 37° C., has a viscosity index of at least 20, and is miscible in combination with the tetrafluoroethane in the range between −40° C. and at least +20° C. The reference does not teach or suggest the present refrigeration compositions. See also U.S. Pat. No. 4,948,525.

U.K. Patent 1,087,283; U.S. Pat. Nos. 3,483,129; 4,052,277; 4,118,398; 4,379,768; 4,443,349; 4,675,452; 4,827,042; 4,898,991; and 4,931,199; International Publications WO 87/02992 and WO 87/02993; and Kokai Patent Publication 118,598 published May 11, 1989 teach perfluorinated ethers and perfluoropolyethers as lubricants. The references do not teach that their lubricants are useful with R134a. Also, Kokai Patent Publication 146,996, published June 30, 1987, teaches the addition of a perfluoroalkylpolyether as an extreme pressure additive to mineral oil.

Carre, "The Performance of Perfluoropolyalkyether Oils under Boundary Lubrication Conditions", *TRIBOLOGY TRANSACTIONS* 31(4), 437 (1987) and Carre, 1988 Air Force Report discuss the problems of perfluoropolyalkylethers and boundary lubrication in spacecraft.

U.K. Patent 1,354,138 teaches compounds of the formula:

$$R-(-[(L)(CH)_z-CH_2-O-]_x-R_f)_m$$

wherein L is —H or —$CH_3$ and z is 0, 1, or 2 on page 1, lines 9–41. As such, the oxyalkylene group can be oxymethylene when z is 0, ethylene oxide when z is 1 and L is —H, straight chain propylene oxide when z is 2 and L is —H, branched propylene oxide when z is 1 and L is —$CH_3$, and branched oxypentylene when z is 2 and L is —$CH_3$. These materials are taught to be useful as surfactants.

U.S. Pat. No. 4,079,084 teaches a compound having a chain of repeating units which may be oxyalkylidine, oxymethylene, oxyalkylene, imino alkylene, or secondary amido chains and at least two terminal perfluorocarbon groups of at least three carbon atoms. For the oxyalkylene unit, the reference teaches ethylene oxide, propylene oxide, or butylene oxide. These materials are taught to be useful as surfactants.

U.S. Pat. No. 2,723,999 teaches compounds of polyethylene glycols or polypropylene glycols. These materials are taught to be useful as surface active agents.

U.S. Pat. No. 4,359,394 teaches that a minor portion of an additive such as a fluorinated aromatic, for example, benzotrifluoride, can be added to a conventional lubricant such as mineral oil. The reference does not teach that a fluorinated aromatic alone is useful as a lubricant.

U.S. Pat. No. 4,944,890 teaches a refrigerant composition of R134a and a copolymer of a fluorinated olefin and $nC_4H_9OCH{=}CH_2$.

Because it is expected that R134a will become widely used in the field of refrigeration and air-conditioning, new improved lubricants useful with R134a are needed in the art.

SUMMARY OF THE INVENTION

Considering that perfluorinated ethers and perfluoropolyethers are immiscible with R134a over a wide temperature range so as to be unsuitable as lubricants for automotive air-conditioning purposes, it is surprising that polyoxyalkylene glycol compositions having at least one pendant non-terminal perfluorinated alkyl group on their hydrocarbon polymer backbone are miscible with a refrigerant selected from the group consisting of hydrofluorocarbon, hydrochlorofluorocarbon, fluorocarbon, and chloroflorocarbon. More particularly, the present lubricants are miscible with tetrafluoroethane. It is even more surprising that polyoxyalkylene glycol compositions having pendant non-terminal alkyl groups on their hydrocarbon polymer backbone wherein at least about 40% of the non-terminal pendant alkyl groups are perfluorinated have improved miscibility when compared with the polyoxyalkylene glycols having a cap of a fluorinated alkyl group on at least one end thereof of allowed commonly assigned U.S. Pat. NO. 4,975,212.

As such, the present invention provides a composition for use in compression refrigeration and air-conditioning comprising: (a) a refrigerant selected from the group consisting of hydrofluorocarbon, hydrochlorofluorocarbon, fluorocarbon, and chlorofluorocarbon; and (b) a sufficient amount to provide lubrication of at least one polyoxyalkylene glycol.

The polyoxyalkylene glycol has pendant non-terminal alkyl groups on its hydrocarbon polymer backbone wherein of the total number of pendant non-terminal alkyl groups in the polyoxyalkylene glycol, at least one of the pendant alkyl groups is perfluorinated or in other words, at least about 2% of the pendant alkyl groups are perfluorinated. The polyoxyalkylene glycol is terminated with a group selected from the group consisting of hydrogen, alkyl, and fluoroalkyl. The polyoxyalkylene glycol has a molecular weight between about 300 and about 4,000, and a viscosity of about 5 to about 300 centistokes at 37° C. The polyoxyalkylene glycol is miscible in combination with tetrafluoroethane in the range between −40° C. and at least +20° C. Preferably, the viscosity of the polyoxyalkylene glycol is about 5 to about 150 centistokes at 37° C.

Preferably, the present lubricants have at least about 40% of their pendant non-terminal alkyl groups as perfluorinated groups. When used in combination with R134a, these lubricating compositions provide improved ranges of miscibility. Comparable to the fluorinated refrigeration lubricants of commonly assigned allowed U.S. Pat. No. 4,975,212, the present lubricants when used with R134a have low upper critical solution temperatures (UCST) which are consistent over a range of viscosities taken at 37° C. Although the compositions of commonly assigned allowed U.S. Pat. No. 4,975,212 exhibit wide miscibility ranges, it has been found that the present lubricants have higher lower critical solution temperatures (LCST), over a range of viscosities taken at 37° C., compared with the lubricants of commonly assigned allowed U.S. Pat. No. 4,975,212. The term "higher lower critical solution temperatures" as used herein means the following For the known lubricants of commonly assigned allowed U.S. Pat. No. 4,975,212, assume that with a first fixed viscosity at 37° C., the miscibility range with R134a extends to a LCST of T1. In contrast with the present lubricants at the same viscosity, the miscibility range with R134a extends to a LCST of T2 wherein T2>T1. This unexpectedly superior property provides better operations at higher temperatures due to improved miscibility. Thus, the present lubricants when used with R134a are advantageous to use because they have wide miscibility ranges with consistent low UCSTs and higher LCSTs.

The present invention also provides a method for improving lubrication in refrigeration and air-conditioning equipment using a refrigerant selected from the group consisting of hydrofluorocarbon, hydrochlorofluorocarbon, fluorocarbon, and chlorofluorocarbon. The method comprises the step of: employing as a lubricant at least one polyoxyalkylene glycol. The polyoxyalkylene glycol has at least one pendant non-terminal perfluorinated alkyl group on its hydrocarbon polymer backbone. The polyoxyalkylene qlycol is terminated with a group selected from the group consisting of hydrogen, alkyl, and fluoroalkyl. The polyoxyalkylene qlycol has a molecular weight of about 300 to about 4,000 and a viscosity of about 5 to about 300 centistokes at 37° C. The polyoxyalkylene glycol is miscible in combination with the tetrafluoroethane in the range between about −40° C. and at least about +20° C.

Other advantages of the present invention will become apparent from the following description and appended claims.

DETAILED DESCRIPTION OF THE PREFERRED EMBODIMENTS

Refrigerants

The present lubricating compositions may be used in most lubricating applications but they are particularly useful with R134a.

The invention relates to the substitution of tetrafluoroethane, and preferably, 1,1,1,2-tetrafluoroethane for R-12 which has been considered to present a danger to the atmospheric ozone layer. R134a has physical characteristics which allow its substitution for R-12 with only a minimum of equipment changes although it is more expensive and unavailable in large quantities at the present time. Its symmetrical isomer, R134, may also be used. The detrimental effect of tetrafluoroethane on atmospheric ozone is considered to be much less than the effect of R-12, and therefore, the substitution of tetrafluoroethane for R-12 is considered probable in the future.

Until R134a becomes available in commercial quantities, it may be produced by any known method including reacting ethylene with carbon having elemental fluorine adsorbed therein as taught by commonly assigned U.S. Pat. No. 4,937,398 which is incorporated herein by reference.

It has been found that the present lubricants are also suitable for use with R12, R22, and R502 which are all refrigerants now available in commercial quantities. A composition for use in refrigeration and air-conditioning comprising: (a) R12, R22, or R502; and (b) the present novel lubricating compositions may be used until 134a becomes available in commercial quantities. When R134a is available in commercial quantities, it may be useful to blend R134a with R12, R22, or R502. R134a, R12, R22, or R502 may also be blended with one of the following: methylene fluoride (known in the art as R32), 1-chloro-1,1,2,2-tetrafluoroethane(known in the art as R124a), pentafluoroethane (known in the art as R125), 1-chloro-1,1-difluoroethane(known in the art as R142b), 1,1,1-trifluoroethane (known in the art as R143a), 1,1-difluoroethane(known in the art as R152a), and cycloperfluorobutane(known in the art as RC318). However, it should be understood that only refrigerant blends and more specifically, blends of tetrafluoroethane with other refrigerants which are miscible with the lubricants of the invention in the range of about −40° C. to at least +20° c., are included.

R-12 is used in very large quantities and of the total, a substantial fraction is used for automotive air-conditioning. Consequently, the investigation of the lubricants needed for use with R134a (or R134) has emphasized the requirements of automotive air-conditioning since the temperature range is generally higher than that of other refrigeration systems, i.e., about 0° C. to 93° C. Since it has been found that R134a differs in being much less miscible with common lubricants than R-12, the substitution of refrigerants becomes more difficult.

Lubricants

R-12 is fully miscible in ordinary mineral oils and consequently, separation of the lubricants is not a problem. Although it is similar to R12, R134a is relatively immiscible in many lubricants as may be seen by reference to commonly assigned U.S. Pat. No. 4,755,316. Thus, it is necessary to find suitable lubricants which are miscible with R134a (or R134) to avoid refrigerant and lubricant separation.

It is characteristic of some refrigerant-lubricant mixtures that a temperature exists above which the lubricant separates. Since this phenomenon occurs also at some low temperatures, a limited range of temperatures within which the two fluids are miscible may occur. Ideally, this range should span the operating temperature range in which the refrigerant is to operate, but often this is not possible. It is typical of automotive air-conditioning systems that a significant fraction of the circulating charge is lubricant and the refrigerant and lubricant circulate together through the system. Separation of the lubricant and refrigerant as they return to the compressor could result in erratic lubrication of the moving parts and premature failure. Other air-conditioning system types usually circulate only the relatively smaller amount of lubricant which is carried by the refrigerant gas passing through the compressor and should be less sensitive to the separation problem. Especially with automotive air-conditioning, separation of the relatively large amount of lubricant circulating with the refrigerant can also affect the performance of other parts of the system.

In a typical automotive air-conditioning system, the temperatures at which the refrigerant is condensed originally will be about 50°–70° C. but may reach 90° C. in high ambient temperature operation. The condensation of hot refrigerant gases in the condensing heat exchanger can be affected if the exchanger is coated with lubricant preferentially so that condensation of the refrigerant occurs by contact with the lubricant film. Thereafter, the two-phase mixture of lubricant and refrigerant must pass through a pressure reduction to the low temperature stage where the refrigerant evaporates and absorbs the heat given up in cooling air and condensing moisture. If lubricant separates at the condenser, then the performance of the evaporator stage can be affected if separate phases persist as the two-phase mixture passes through the pressure reduction step. As with the condenser, accumulation of lubricant on the evaporator coils can affect heat exchange efficiency. In addition, the low evaporator temperatures may result in excessive cooling of the lubricant resulting in a more viscous liquid and trapping of the lubricant in the evaporator. These problems can be avoided if the lubricant and the refrigerant are fully miscible throughout the operating temperature ranges, as was true with R-12 and mineral oil mixtures. R134a, with its limited ability to dissolve lubricants, presents a problem which must be solved.

Preferably, the lubricating composition comprises the Formula (I):

$$R'[(R_f)CHCH_2O]_m[RCHCH_2O]_nR'$$

wherein R' is selected from the group consisting of hydrogen, alkyl, or fluoroalkyl; m is 2 to 40; n is 0 to 60; R is selected from the group consisting of hydrogen and alkyl, and $R_f$ is a perfluoroalkyl group. Preferred R' alkyl groups have 1 to 12 carbon atoms and can be straight chain or branched. Examples include methyl, ethyl, n-propyl, isopropyl, n-butyl, sec-butyl, tert-butyl, n-pentyl, isopentyl, neopentyl, and the like.

Preferred fluoroalkyl groups are of the Formula (II):

$$-(CH_2)_x(CF_2)_yCH_3$$

wherein x is 1 to 4 and y is 0 to 15. More preferably, x is 1 and y is 0 so that at least one of R is a fluorinated alkyl group of the formula $-CH_2CF_3$ or x is 1 and y is 2 so that at least one of R is a fluorinated alkyl group of the formula $-CH_2(CF_2)_2CH_3$. The fluorinated alkyl group may also be branched.

preferred R alkyl groups have 1 to 5 carbon atoms and include methyl, ethyl, n-propyl, isopropyl, n-butyl, Sec-butyl, tert-butyl, n-pentyl, isopentyl, neopentyl, and the like.

Preferred perfluoroalkyl groups are of the Formula (III):

$$C_nF_{2n+1}$$

wherein n is 1 to 8 and include perfluoromethyl, perfluoroethyl, perfluoropropyl, perfluorobutyl, perfluoropentyl, perfluorohexyl, perfluoroheptyl, and perfluorooctyl.

As such, the present lubricating composition may be terminated by a hydrogen at one end and an alkyl group at the other end, by a hydrogen at one end and a fluorinated alkyl group at the other end, by an alkyl group at one end and a fluorinated alkyl group at the other end, by a hydrogen at both ends, by an alkyl group at both ends, or by a fluorinated alkyl group at both ends.

Preferably, at least 40% of the non-terminal pendant alkyl groups are perfluorinated. As such, the ratio of m to n is Formula (I) above is at least 2:3.

Preferred lubricating compositions are $$HO[R_fCHCH_2O]_m[RCHCH_2O]_nH$$

$$CH_3O[R_fCHCH_2O]_m[RCHCH_2O]_nCH_3$$

$$CF_3CH_2O[R_fCHCH_2O]_m[RCHCH_2O]_nCH_2CF_3$$

$$C_3F_7CH_2O[R_fCHCH_2O]_m[RCHCH_2O]_nCH_2C_3F_7$$

where m is 2 to 40 and n is 0 to 60.

The most preferred lubricating compositions are:

$$HO-[R_fCHCH_2O]_mH$$

$$CH_3O[R_fCHCH_2O]_mCH_3$$

$$CF_3CH_2O[R_fCHCH_2O]_mCH_2CF_3$$

$$C_3F_7CH_2O[R_fCHCH_2O]_mOCH_2C_3F_7$$

where m is 2 to 40.

The lubricating compositions may be formed by any known method including polymerizing 3,3,3-trifluoro-1,2-epoxypropane as taught by F. Trischler et al.,"-Preparation of Fluorine-Containing Polyethers", *J. of Polymer Science* 5(A-1),2313 (1967).

Commercially available 3,3,3-trifluoro-1,2-epoxypropane may be used or 3,3,3-trifluoro-1,2-epoxypropane may be prepared by any known method including dehydrohalogenation of 3-bromo-1,1,1-trifluoro-2-propanol as taught by E. McBee et al., "The Preparation and Properties of 3,3,3-Trifluoro-1,2-Epoxypropane", *J. Amer. Chem. Soc.* 74, 3022 (1952). The 3-bromo-1,1,1-trifluoro-2-propanol may be prepared by the bromination of commercially available trifluoroacetone to form 3-bromo-1,1,1-trifluoropropanone which may then be reduced with lithium aluminum hydride.

Preferably, the lubricating compositions are prepared by reacting 3,3,3-trifluoro-1,2-epoxypropane with either an anionic or cationic initiator at elevated temperature. The lubricating compositions are isolated directly from the reaction mixture.

The present lubricants have higher low critical solution temperatures when used with R134a and consequently, they are an improvement on the compositions of tetrafluoroethane and fluorinated polyoxyalkylene glycols of commonly assigned allowed U.S. Pat. No. 4,975,212. The present lubricants operate without separation from R134a over much of the operating temperature range. Any separation which does occur would preferably be at the higher temperatures, and thus, would affect the condenser rather than the lower temperature evaporator.

A blend of the present lubricating compositions wherein the compositions have different molecular weights may be used in practicing the present invention.

The present lubricating compositions are miscible in combination with tetrafluoroethane in the range between about −40° C. and at least about +20° C., preferably at least about +30° C., more preferably at least about +40° C., and most preferably at least about +50° C.

Preferably, the tetrafluoroethane and lubricant are used in a weight ratio of about 99:1 to about 1:99, and more preferably, in a weight ratio of about 99:1 to about 70:30.

The range of miscibility is not the only factor to be considered when one is selecting a lubricant for automotive air-conditioning service (or other refrigeration applications). Lubricating properties also must be satisfactory for the intended application. Practically, this means that for automotive air conditioning, the viscosity of the lubricant will be about 5–150 centistokes, preferably about 100 centistokes (CS) at 37° C. with a viscosity index of at least 20 in order that the lubricant is sufficiently viscous at high temperatures to lubricate while remaining sufficiently fluid to circulate around the refrigeration circuit at low temperatures. The range of viscosity may also be expressed as about 3–24 CS at 98.9° C. In addition, the lubricant should be chemically stable and not cause corrosion or other problems in long-term service. Other factors which should be considered in selecting lubricants are compatibility, lubricity, safety, and the like.

Additives which may be used to enhance performance include (1) extreme pressure and antiwear additives, (2) oxidation and thermal stability improvers, (3) Corrosion inhibitors, (4) viscosity index improvers, (5) pour and floc point depressants, (6) detergent, (7) anti foaming agents, and (8) viscosity adjusters.

Typical members of these classes are listed in TABLE 1 below.

TABLE 1

| Class Additive | Typical Members of the Class |
|---|---|
| 1. Extreme pressure and anti-wear | phosphates, phosphate esters (bicresyl phosphate), phosphites, thiophosphates (zinc diorganodithiophosphates) chlorinated waxes, sulfurized fats and olefins, organic lead compounds, fatty acids, molybdenum complexes, halogen substituted organosilicon compounds, borates, organic esters, halogen substituted phosphorous compounds, sulfurized Diels Alder adducts, organic sulfides, compounds containing chlorine and sulfur, metal salts of organic acids. |
| 2. Oxidation and thermal stability improvers | sterically hindered phenols (BHT), aromatic amines, dithiophosphates, phosphites, sulfides, metal salts of dithio acids. |
| 3. Corrosion Inhibitors | organic acids, organic amines, organic phosphates, organic alcohols, metal sulfonates, organic phosphites. |
| 4. Viscosity index improvers | polyisobutylene, polymethacrylate, polyalkylstyrenes. |
| 5. Pour Point &/ or floc point depressants | polymethacrylate ethylene-vinyl acetate copolymers, succinamic acid-olefin copolymers, ethylene-alpha olefin copolymers, Friedel-Crafts condensation products of wax with naphthalene or phenols. |
| 6. Detergents | sulfonates, long-chain alkyl substituted aromatic sulfonic acids, phosphonates, thiophosphonates, phenolates, metal salts of alkyl phenols, alkyl sulfides, alkylphenol-aldehyde condensation products, metal salts of substituted salicylates, N-substituted oligomers or polymers from the reaction products of unsaturated anhydrides and amines, copolymers of methacrylates with N-substituted compounds such as N-vinyl pyrrolidone or dimethylaminoethyl methacrylate, copolymers which incorporate polyester linkages such as vinyl acetate-maleic anhydride copolymers. |
| 7. Anti-Foaming Agents | silicone polymers |
| 8. Viscosity Adjusters | Polyisobutylene, polymethacrylates, polyalkylstyrenes, naphthenic oils, alkylbenzene oils, paraffinic oils, polyesters, polyvinylchloride, polyphosphates. |

The present invention is more fully illustrated by the following non-limiting Examples.

COMPARATIVES 1–5

Comparatives 1–5 demonstrate that perfluorinated ethers and perfluoropolyethers are not useful as lubricants with R134a because they are immiscible with R134a over a wide temperature range which is unsuitable for automotive air-conditioning purposes. Most automotive air-conditions operate at about 0° to 93° C. and useful lubricants operated at about −30° to 93° C. Table 2 contains the results of the Comparatives. The viscosities are at 37° C.

TABLE 2

| COMP. | ETHER | VISC. (CS) | MW | ETHER WT. % | MISC (°C.) |
|---|---|---|---|---|---|
| 1 | KRYTOX 143AB (Dupont) (registered trademark) | 85 | 3700 | 15 | Immiscible at and below 10.2 |
| 2 | KRYTOX 143AX (registered trademark) | 150 | 4800 | 15 | Immiscible at and below 20.4 |

TABLE 2-continued

| COMP. | ETHER | VISC. (CS) | MW | ETHER WT. % | MISC (°C.) |
|---|---|---|---|---|---|
| 3 | KRYTOX 143CZ (registered trademark) | 125 | 4400 | 15 | Immiscible at and below 19.6 |
| 4 | BRAYCO 1724 (Bray) (registered trademark) | 65.5 | — | 15 | Immiscible at and below 18.4 |
| 5 | S-100 (Daikin) (registered trademark) | 100 | 4600 | 15 | Immiscible at and below 30.0 |

COMPARATIVES 6-10

For comparative purposes, the following Table 3 was generated based on the compositions of R134a and fluorinated polyoxyalkylene glycols of allowed commonly assigned U.S. Pat. No. 4,875,212. The fluorinated polyoxyalkylene glycols have the formula $CF_3CH_2OCH(CH_3)CH_2O[CH_2CH(CH_3)O]_mCH_2CF_3$

TABLE 3

| COMP. | m | MW | VISC. (CS) | EX WT. % | MISC (°C.) |
|---|---|---|---|---|---|
| 6 | 15 | 991 | 33 | 14 | −60 to over 70 |
| 7 | 20 | 1366 | 56 | 14 | −60 to over 80 |
| | | | | 50 | −60 to over 70 |
| 8 | 26 | 1666 | 78 | 14 | −60 to 67 |
| | | | | 50 | −60 to over 70 |
| 9 | 29 | 1866 | 91 | 6 | −60 to 64.2 |
| | | | | 15 | −60 to 59.5 |
| | | | | 22 | −60 to 63.3 |
| | | | | 30 | −60 to 67 |
| | | | | 39 | −60 to 75 |
| | | | | 50 | −60 to 74 |
| 10 | 34 | 2166 | 127 | 14 | −60 to 42.6 |
| | | | | 50 | −60 to over 70 |

EXAMPLES 1-9

Examples 1 to 9 are directed to the preparation of lubricants useful in the present invention.

EXAMPLE 1

This Example is directed to the preparation of poly(trifluoromethylethyleneglycol) which has the formula $HO—[(CF_3)CHCH_2O]_mH$ wherein m is about 10.

3,3,3-Trifluoro-1,2-epoxypropane (300grams, 2.68 moles) and borontrifluoride-etherate were reacted in a 600 milliliter autoclave at an initial temperature of −78° C. During the course of the reaction (2 hours), the temperature was allowed to warm to ambient conditions (27° C.). After this period, residual pressure was vented from the system. Ether (200 milliliters) was added to dissolve the product. The ether solution was washed with saturated sodium bicarbonate, dried ($MgSO_4$), and distilled from the product. Yield of the polymer which was isolated as a light yellow oil was 210 grams (70%). Analysis of the product gave an hydroxyl number value of 102 which corresponds to a molecular weight of 1100.

EXAMPLE 2

This Example is also directed to the preparation of poly(trifluoromethylethyleneglycol) which has the formula $HO—[(CF_3)CHCH_2O]_mH$ wherein m is 24.

The product of this reaction was identical to that of Example 1, except that the molecular weight was increased to give a more viscous product. This transformation was accomplished by using aluminum chloride as the Friedel-Crafts catalyst. Yield of the polymer which was isolated as a clear, colorless oil was 221 grams (74%). Analysis of the product gave an hydroxyl number of 40 which corresponds to a molecular weight of 2800.

EXAMPLE 3

This Example is also directed to the preparation of poly(trifluoromethylethyleneglycol) which has the formula $HO—[(CF_3)CHCH_2O]_mH$ wherein m is 36.

The product of this reaction was identical to Example 1, except that the catalyst was changed to increase the molecular weight. For this Example, potassium hydroxide was used as the anionic initiator. Yield of polymer isolated as a colorless oil was 174 grams (58%). Analysis of the product gave an hydroxyl number of 28 which corresponds to a molecular weight of 4000.

EXAMPLE 4

This Example is directed to the preparation of alpha,omega-dimethyl(polytrifluoromethylethyleneglycol) which has the formula $CH_3O—[(CF_3)CHCH_2O]_mCH_3$ wherein m is 10.

The polymeric diol isolated in Example 1 (100 grams, 0.1 mole) was dissolved in butylether (100 milliliters). Triethylamine (26.3 grams, 0.26 mole) was added and the reaction mixture cooled to 5° C. Methanesulfonylchloride (25.2 grams, 0.22 mole) was added dropwise. After stirring for 4 hours, the reaction was quenched with hydrochloric acid (6N, 100 milliliters). The resulting phases were separated and the ether layer was washed with an additional hydrochloric acid wash (6N, 100 milliliters). Finally, the ether layer was washed with ammonium hydroxide (7N, 100 milliliters), dried and the solvent was removed to yield the dimesylate of poly(trifluoromethylethyleneglycol). Yield 113 grams (90%).

The dimesylate was reacted with sodium methoxide (11.9grams, 0.22 mole) in butylether (200 milliliters) at 85° C. for 6 hours. Workup as described above yielded the dimethyl product as a colorless oil. Yield 92 grams (90%).

EXAMPLE 5

This Example is directed to the preparation of alpha,omega-bis-1,1,1-trifluoroethylpoly(trifluoromethylethylene glycol) which has the formula $CF_3CH_2O[(CF_3)CHCH_2O]_mCH_2CF_3$ wherein m is 10.

This material was prepared similar to that described in Example 4 except that the alkoxide was changed to sodium trifluoroethanolate. Yield of the colorless oil was 102 grams (90%).

EXAMPLE 6

This Example is directed to the preparation of alpha,omega-bis-1H,1H-heptafluorobutylpoly(trifluoromethylethyleneglycol) which has the formula $CF_3(CF_2)_2CH_2O—[(CF_3)CHCH_2O]CH_2(CF_2)_2CF_3$ wherein m is 10.

This material was prepared in a manner to that described in Example 4, except that the alkoxide was changed to 1H,1H-heptafluorobutanoate. Yield of the colorless oil was 118.5grams (90%).

EXAMPLE 7

This Example is directed to the preparation of alpha,omega-bis-trifluoroethyl-poly[(trifluoromethylethylene) (propylene)]glycol which has the formula $CF_3CH_2O[(CF_3)CHCH_2O]_m[(CH_3)CHCH_2O]_nCH_2CF_3$ where m is 2 and n is 25 which equals 7% non-terminal pendant perfluorinated alkyl groups and a molecular weight of 1,852.

36.3 grams (0.62 mole) of propylene oxide, 10 grams (0.089 mole) of trifluoropropylene oxide, and 0.02 milliliter of boron trifluoride etherate were reacted in a 300 milliliter autoclave at ambient temperature for 2 hours at 29° C. Residual pressure was vented. 200 milliliters of ether were added to dissolve the product. The product solution was washed with saturated $NaHCO_3$ (2×50 milliliters) and then dried over $MgSO_4$. The ether was removed by distillation to leave a yellow oil. The yield was 33.3 grams (72%). Analysis of the product gave a hydroxyl number of 66 which corresponds to a molecular weight of 1,690.

The preceding product was reacted with 4.5 grams (0.039 mole) MsCl, 5 grams (0.049 mole) $Et_3N$, and 150 milliliters of $Bu_2O$ to form the dimesylate. The MsCl was slowly added to the product solution in $Bu_2O$-/$Et_2N$ at 0° C. After addition of MsCl was complete after about ten minutes, the reaction was warmed to room temperature to complete the formation of dimesylate. The precipitated salt was removed by filtration, the filter cake was washed with 50 milliliters of $Bu_2O$, and the filtrates were combined. By NMR and IR analysis, the capping was quantitative.

The preceding product was then added to a solution containing 0.041 mole of $NaOCH_2CF_2$ in 50 milliliters of $Bu_2O$. The reaction temperature was raised to 110° C. for two hours. The reaction was cooled in an ice bath to 0° C. and the NaOMs salt filtered. The filter cake was washed with 50 milliliters $Bu_2O$ and the filtrates were combined. The product was washed with 2×50 milliliters 3N HCl and then 1×50 milliliters 5% $NH_4OH$. The organic layer was dried over $MgSO_4$, filtered and the solvent removed under reduced pressure. A viscous oil of 92 centistokes at 37° C. was obtained. The yield of yellow oil was 30.7 grams (85%).

EXAMPLE 8

This Example is directed to the preparation of alpha,omega-bis-trifluoroethyl-poly[(trifluoromethylethylene) (propylene)]glycol which has the formula $CF_3CH_2O[(CF_3)CHCH_2O]_m(CH_3)CHCH_2O]_nCH_2CF_3$ where m is 9 and n is 13 which equals 41% non-terminal pendant perfluorinated alkyl groups and a molecular weight of 1,940.

25 grams (0.22 mole) of trifluoropropene oxide and 18.7 grams (0.32 mole) of propylene oxide were charged into a 300 milliliter autoclave. The autoclave was cooled to −78° C. and 0.2 milliliter of boron trifluoride etherate was added. The autoclave was warmed to 28° C. and maintained at this temperature for two hours. Excess pressure was vented and the product dissolved in 200 milliliters of $Et_2O$. The organic phase was washed with 2×50 milliliters of saturated $NaHCO_3$, dried over $MgSO_4$, and then the solvent was removed under reduced pressure. A clear colorless oil resulted. The yield was 33.6 grams (77%). Analysis of the product gave a hydroxyl number of 64 which corresponds to a molecular weight of 1750.

The resulting diol was converted to the dimesylate by reacting 33 grams of the product in 200 milliliters of $Bu_2O$ containing 50 milliliters of $Et_3N$ with 4.7 grams of MsCl at 0° C. After the addition was complete, the reaction was warmed to room temperature and stirred for one hour. The salts were removed by filtration, the filter cake was washed with 50 milliliters of $Bu_2O$, and the filtrates were combined. Based on NMR and IR, the conversion was quantitative.

The resulting dimesylate was reacted with a solution of $Bu_2O$ (50 milliliters) containing 0.4 mole of $NaOCH_2CF_3$. The reaction was maintained at 110° C. for two hours. The reaction was then cooled to 0° C. and the precipitate NaOMs removed by filtration. The filter cake was washed with 25 milliliters of $Bu_2O$ and the filtrates were combined. The $Bu_2O$/product solution was washed with 2×100 milliliters of 3N HCl and then 50 milliliters of 5% $NH_4OH$. The organic phase was then dried over $MgSO_4$. The $Bu_2O$ was removed by vacuum distillation. A clear yellow oil with a viscosity of 93 centistokes at 37° C. was isolated.

EXAMPLE 9

This Example is directed to the preparation of alpha, omega-bis-trifluoroethyl-poly[(trifluoroethylene)(ethylene)]glycol which has the formula $$CF_3CH_2O[(CF_3)CHCH_2O]_m[CH_2CH_2O]_nCH_2CG_3$$

where m is 12 and n is 18 which equals 40% non-terminal pendant perfluorinated alkyl groups and a molecular weight of 2,315±30.

50 grams (0.446 mole) trifluoropropene oxide and 29 grams (0.669 mole) ethylene oxide were added to a 300 milliliter autoclave. The autoclave was cooled to −8° C. and 0.2 milliliter of boron trifluoride etherate was added. The contents were warmed to 30° C. and maintained for two hours. Excess pressure was vented. The contents were dissolved in 200 milliliters of $Bu_2O$ and then washed with 2×50 milliliters of saturated $NaHCO_3$. After drying over $MgSO_4$, the ether was removed to yield a yellow viscous oil contaminated with a white solid residue. The precipitate was removed by filtration and appeared to be polyethylene. The remaining liquid was the mixed diol. A hydroxyl number of 52 was obtained which corresponded to a molecular weight of 2,150±30. The yield was 45.8 grams (58%).

40 grams of the diol, 200 milliliters $Bu_2O$, and 5 grams of $Et_3N$ were mixed and cooled to 0° C. 4.7 grams of MsCl were added dropwise over a ten minute period. Stirring was maintained for two hours. The precipitated solids were removed by filtration and the filter cake was washed with 50 milliliters $Bu_2O$. The filtrates were combined. NMR and IR analysis indicated that the reaction is quantitative.

The preceding solution was added to a $Bu_2O$ solution containing 0.041 mole of $NaOCH_2CF_3$. The reaction was heated to 110° C. for two hours and then cooled to 0° C. The precipitated salts of NaOMs were removed by filtration and the filter cake was washed with 50 milliliters of $Bu_2O$. The combined filtrates were washed with 2×100 milliliters of 3N HCl and then 100 milliliters of 5% $NH_4OH$. The organic phase was dried over $MgSO_4$. $Bu_2O$ was removed by vacuum distillation. The thick viscous oil was isolated. The yellow oil had a viscosity of 135 centistokes at 37° C.

The miscibility of the lubricating compositions was determined by combining them with refrigerant in a glass tube and observing the results when the tubes were maintained at preselected temperatures. A tube was filled with the desired amount of lubricant and then refrigerant was added while the oil was frozen in liquid nitrogen. The tube was then sealed and immersed in a thermostated bath. After the temperature was equilibrated, the miscibility of the lubricant and refrigerant was determined by visual observation. The results of the tests made with R-134a and the lubricating compositions of Examples 1-9 are shown in Table 4 below. Because the critical temperature of R134a is 93° C., the miscibility apparatus was cut off at 80° C. for safety reasons.

TABLE 4

| | VISC. (CS) | MW | EX WT % | MISC (°C.) |
|---|---|---|---|---|
| Ex. 1 | 84 | 1100 | 14 | −60 to over 80 |
| Ex. 2 | 190 | 2750 | 14 | −60 to over 80 |
| Ex. 3 | >300 | 4000 | 14 | −60 to over 80 |
| Ex. 4 | 40 | 1128 | 14 | −60 to over 80 |
| Ex. 5 | 52 | 1264 | 14 | −60 to over 80 |
| Ex. 6 | 73 | 1464 | 14 | −60 to over 80 |
| Ex. 7 | 92 | 1852 | 15 | −60 to 61.3 |
| Ex. 8 | 93 | 1940 | 15 | −60 to 76 |
| Ex. 9 | 135 | 2315 | 14 | −60 to 67 |

EXAMPLES 10-225

The following lubricants are combined with each of R12 and R134a and the miscibility is determined as described for Examples 1-9 above; each lubricant exhibits satisfactory miscibility. MW stands for molecular weight.

| EX | Lubricant | MW |
|---|---|---|
| 10 | $HO—[(F_3C)CH—CH_2—O]_3—CH_3$ | 368 |
| 11 | $HO—[(F_5C_2)CH—CH_2—O]_8—CH_3$ | 1,328 |
| 12 | $HO—[(F_7C_3)CH—CH_2—O]_{12}—CH_3$ | 2,576 |
| 13 | $HO—[(F_9C_4)CH—CH_2—O]_{15}—CH_3$ | 3,958 |
| 14 | $HO—[(F_3C)CH—CH_2—O]_3—C_2H_5$ | 382 |
| 15 | $HO—[(F_5C_2)CH—CH_2—O]_9—C_2H_5$ | 1,504 |
| 16 | $HO—[(F_7C_3)CH—CH_2—O]_{13}—C_2H_5$ | 2,802 |
| 17 | $HO—[(F_9C_4)CH—CH_2—O]_{15}—C_2H_5$ | 3,976 |
| 18 | $HO—[(F_3C)CH—CH_2—O]_6—C_3H_7$ | 732 |
| 19 | $HO—[(F_5C_2)CH—CH_2—O]_{10}—C_3H_7$ | 1,680 |
| 20 | $HO—[(F_7C_3)CH—CH_2—O]_{14}—C_3H_7$ | 3,028 |
| 21 | $HO—[(F_9C_4)CH—CH_2—O]_{12}—C_3H_7$ | 3,204 |
| 22 | $HO—[(F_3C)CH—CH_2—O]_7—C_4H_9$ | 858 |
| 23 | $HO—[(F_5C_2)CH—CH_2—O]_{11}—C_4H_9$ | 1,856 |
| 24 | $HO—[(F_7C_3)CH—CH_2—O]_{15}—C_4H_9$ | 3,254 |
| 25 | $HO—[(F_9C_4)CH—CH_2—O]_4—C_4H_9$ | 1,122 |
| 26 | $HO—[(F_3C)CH—CH_2—O]_{20}—CH_2CF_3$ | 2,340 |
| 27 | $HO—[(F_5C_2)CH—CH_2—O]_{24}—CH_2CF_3$ | 3,988 |
| 28 | $HO—[(F_7C_3)CH—CH_2—O]_4—CH_2CF_3$ | 948 |
| 29 | $HO—[(F_9C_4)CH—CH_2—O]_8—CH_2CF_3$ | 2,196 |
| 30 | $HO—[(F_3C)CH—CH_2—O]_{21}—CH_2C_3F_7$ | 2,552 |
| 31 | $HO—[(F_5C_2)CH—CH_2—O]_{20}—CH_2C_3F_7$ | 3,427 |
| 32 | $HO—[(F_7C_3)CH—CH_2—O]_{15}—CH_2C_3F_7$ | 3,380 |
| 33 | $HO—[(F_9C_4)CH—CH_2—O]_{10}—CH_2C_3F_7$ | 2,820 |
| 34 | $CH_3O—[(F_3C)CH—CH_2—O]_5—CH_2CF_3$ | 674 |
| 35 | $CH_3O—[(F_5C_2)CH—CH_2—O]_9—CH_2CF_3$ | 1,572 |
| 36 | $CH_3O—[(F_7C_3)CH—CH_2—O]_{13}—CH_2CF_3$ | 2,870 |
| 37 | $CH_3O—[(F_9C_4)CH—CH_2—O]_{14}—CH_2CF_3$ | 3,782 |
| 38 | $CH_3O—[(F_3C)CH—CH_2—O]_8—CH_2C_3F_7$ | 1,110 |
| 39 | $CH_3O—[(F_5C_2)CH—CH_2—O]_7—CH_2C_3F_7$ | 1,005 |
| 40 | $CH_3O—[(F_7C_3)CH—CH_2—O]_6—CH_2C_3F_7$ | 1,486 |
| 41 | $CH_3O—[(F_9C_4)CH—CH_2—O]_5—CH_2C_3F_7$ | 1,524 |
| 42 | $C_2H_5O—[(F_3C)CH—CH_2—O]_{12}—CH_2CF_3$ | 1,472 |
| 43 | $C_2H_5O—[(F_5C_2)CH—CH_2—O]_{11}—CH_2CF_3$ | 1,910 |
| 44 | $C_2H_5O—[(F_7C_3)CH—CH_2—O]_{10}—CH_2CF_3$ | 2,248 |
| 45 | $C_2H_5O—[(F_9C_4)CH—CH_2—O]_9—CH_2CF_3$ | 2,486 |
| 46 | $C_2H_5O—[(F_3C)CH—CH_2—O]_{16}—CH_2C_3F_7$ | 2,020 |
| 47 | $C_2H_5O—[(F_5C_2)CH—CH_2—O]_{15}—CH_2C_3F_7$ | 2,658 |
| 48 | $C_2H_5O—[(F_7C_3)CH—CH_2—O]_{14}—CH_2C_3F_7$ | 3,196 |
| 49 | $C_2H_5O—[(F_9C_4)CH—CH_2—O]_{13}—CH_2C_3F_7$ | 3,634 |
| 50 | $C_3H_7O—[(F_3C)CH—CH_2—O]_{17}—CH_2CF_3$ | 2,063 |
| 51 | $C_3H_7O—[(F_5C_2)CH—CH_2—O]_{16}—CH_2CF_3$ | 2,734 |
| 52 | $C_3H_7O—[(F_7C_3)CH—CH_2—O]_{15}—CH_2CF_3$ | 3,322 |
| 53 | $C_3H_7O—[(F_9C_4)CH—CH_2—O]_{14}—CH_2CF_3$ | 3,810 |
| 54 | $C_3H_7O—[(F_3C)CH—CH_2—O]_7—CH_2C_3F_7$ | 1,033 |
| 55 | $C_3H_7O—[(F_5C_2)CH—CH_2—O]_6—CH_2C_3F_7$ | 1,214 |
| 56 | $C_3H_7O—[(F_7C_3)CH—CH_2—O]_5—CH_2C_3F_7$ | 1,302 |
| 57 | $C_3H_7O—[(F_9C_4)CH—CH_2—O]_4—CH_2C_3F_7$ | 1,290 |
| 58 | $C_4H_9O—[(F_3C)CH—CH_2—O]_8—CH_2CF_3$ | 1,052 |
| 59 | $C_4H_9O—[(F_5C_2)CH—CH_2—O]_7—CH_2CF_3$ | 1,290 |
| 60 | $C_4H_9O—[(F_7C_3)CH—CH_2—O]_6—CH_2CF_3$ | 1,428 |
| 61 | $C_4H_9O—[(F_9C_4)CH—CH_2—O]_5—CH_2CF_3$ | 1,466 |
| 62 | $C_4H_9O—[(F_3C)CH—CH_2—O]_9—CH_2C_3F_7$ | 1,264 |
| 63 | $C_4H_9O—[(F_5C_2)CH—CH_2—O]_8—CH_2C_3F_7$ | 1,552 |
| 64 | $C_4H_9O—[(F_7C_3)CH—CH_2—O]_7—CH_2C_3F_7$ | 1,740 |
| 65 | $C_4H_9O—[(F_9C_4)CH—CH_2—O]_6—CH_2C_3F_7$ | 1,828 |
| 66 | $HO[(F_3C)CH—CH_2—O]_{29}—OH$ | 3,311 |
| 67 | $HO[(F_5C_2)CHCH_2O]_{20}OH$ | 3,274 |
| 68 | $HO[(F_7C_3)CHCH_2O]_8OH$ | 1,730 |
| 69 | $HO[(F_9C_4)CHCH_2O]_7OH$ | 1,868 |
| 70 | $CH_3O[(F_3C)CHCH_2O]_{30}CH_3$ | 3,406 |
| 71 | $CH_3O[(F_5C_2)CHCH_2O]_{19}CH_3$ | 3,124 |
| 72 | $CH_3O[(F_7C_3)CHCH_2O]_9CH_3$ | 1,954 |
| 73 | $CH_3O[(F_9C_4)CHCH_2O]_8CH_3$ | 2,142 |
| 74 | $C_2H_5O[(F_3C)CHCH_2O]_{31}C_2H_5$ | 3,577 |
| 75 | $C_2H_5O[(F_5C_2)CHCH_2O]_{18}C_2H_5$ | 2,990 |
| 76 | $C_2H_5O[(F_7C_3)CHCH_2O]_{10}C_2H_5$ | 2,194 |
| 77 | $C_2H_5O[(F_9C_4)CHCH_2O]_9C_2H_5$ | 2,432 |
| 78 | $C_3H_7O[(F_3C)CHCH_2O]_{32}C_3H_7$ | 3,718 |
| 79 | $C_3H_7O[(F_5C_2)CHCH_2O]_{17}C_3H_7$ | 2,856 |
| 80 | $C_3H_7O[(F_7C_3)CHCH_2O]_{11}C_3H_7$ | 2,434 |
| 81 | $C_3H_7O[(F_9C_4)CHCH_2O]_{10}C_3H_7$ | 2,722 |
| 82 | $C_4H_9O[(F_3C)CHCH_2O]_{33}C_4H_9$ | 3,859 |
| 83 | $C_4H_9O[(F_5C_2)CHCH_2O]_{16}C_4H_9$ | 2,722 |
| 84 | $C_4H_9O[(F_7C_3)CHCH_2O]_{12}C_4H_9$ | 2,674 |
| 85 | $C_4H_9O[(F_9C_4)CHCH_2O]_{11}C_4H_9$ | 3,012 |
| 86 | $CH_3O[(F_3C)CHCH_2O]_3C_2H_5$ | 396 |
| 87 | $CH_3O[(F_5C_2)CHCH_2O]_2C_2H_5$ | 384 |
| 88 | $CH_3O[(F_7C_3)CHCH_2O]_2C_2H_5$ | 484 |
| 89 | $CH_3O[(F_9C_4)CHCH_2O]C_2H_5$ | 322 |
| 90 | $CH_3O[(F_3C)CHCH_2O]_4C_3H_7$ | 522 |
| 91 | $CH_3O[(F_5C_2)CHCH_2O]_{15}C_3H_7$ | 2,504 |
| 92 | $CH_3O[(F_7C_3)CHCH_2O]_{13}C_3H_7$ | 2,830 |
| 93 | $CH_3O[(F_9C_4)CHCH_2O]_{12}C_3H_7$ | 3,218 |
| 94 | $CH_3O[(F_3C)CHCH_2O]_5C_4H_9$ | 648 |
| 95 | $CH_3O[(F_5C_2)CHCH_2O]_4C_4H_9$ | 2,736 |
| 96 | $CH_3O[(F_7C_3)CHCH_2O]_{14}C_4H_9$ | 3,056 |
| 97 | $CH_3O[(F_9C_4)CHCH_2O]_{13}C_4H_9$ | 3,494 |
| 98 | $C_2H_5O[(F_3C)CHCH_2O]_6C_3H_7$ | 760 |
| 99 | $C_2H_5O[(F_5C_2)CHCH_2O]_{13}C_3H_7$ | 2,194 |
| 100 | $C_2H_5O[(F_7C_3)CHCH_2O]_{15}C_3H_7$ | 3,268 |
| 101 | $C_2H_5O[(F_9C_4)CHCH_2O]_{14}C_3H_7$ | 3,756 |
| 102 | $C_2H_5O[(F_3C)CHCH_2O]_7C_4H_9$ | 888 |
| 103 | $C_2H_5O[(F_5C_2)CHCH_2O]_{12}C_4H_9$ | 2,046 |
| 104 | $C_2H_5O[(F_7C_3)CHCH_2O]_{15}C_4H_9$ | 3,275 |
| 105 | $C_2H_5O[(F_9C_4)CHCH_2O]_{14}C_4H_9$ | 3,770 |
| 106 | $C_3H_7O[(F_3C)CHCH_2O]_8C_4H_9$ | 1,012 |
| 107 | $C_3H_7O[(F_5C_2)CHCH_2O]_{11}C_4H_9$ | 1,899 |
| 108 | $C_3H_7O[(F_7C_3)CHCH_2O]_{16}C_4H_9$ | 3,508 |
| 109 | $C_3H_7O[(F_9C_4)CHCH_2O]_{13}C_4H_9$ | 3,522 |
| 110 | $F_3CH_2CO[(F_3C)CHCH_2O]_7CH_2CF_3$ | 966 |
| 111 | $F_3CH_2CO[(F_5C_2)CHCH_2O]_8CH_2CF_3$ | 1,478 |
| 112 | $F_3CH_2CO[(F_7C_3)CHCH_2O]_9CH_2CF_3$ | 2,090 |
| 113 | $F_3CH_2CO[(F_9C_4)CHCH_2O]_{10}CH_2CF_3$ | 2,802 |
| 114 | $F_7C_3H_2CO[(F_3C)CHCH_2O]_{11}CH_2C_3F_7$ | 1,614 |
| 115 | $F_7C_3H_2CO[(F_5C_2)CHCH_2O]_{12}CH_2C_3F_7$ | 2,326 |
| 116 | $F_7C_3H_2CO[(F_7C_3)CHCH_2O]_{13}CH_2C_3F_7$ | 3,138 |

-continued

| | | |
|---|---|---|
| 117 | $F_7C_3H_2CO[(F_9C_4)CHCH_2O]_{13}CH_2C_3F_7$ | 3,788 |
| 118 | $F_3CH_2CO[(F_3C)CHCH_2O]_{15}CH_2C_3F_7$ | 1,962 |
| 119 | $F_3CH_2CO[(F_5C_2)CHCH_2O]_{16}CH_2C_3F_7$ | 2,874 |
| 120 | $F_3CH_2CO[(F_7C_3)CHCH_2O]_{17}CH_2C_3F_7$ | 3,869 |
| 121 | $F_3CH_2CO[(F_9C_4)CHCH_2O]_{12}CH_2C_3F_7$ | 3,426 |
| 122 | $HO[(F_3C)CHCH_2O]_2[(CH_2)_2O]CH_3$ | 300 |
| 123 | $HO[(F_5C_2)CHCH_2O]_8[(CH_2)_2O]CH_3$ | 1,372 |
| 124 | $HO[(F_7C_3)CHCH_2O]_{12}[(CH_2)_2O]CH_3$ | 2,620 |
| 125 | $HO[(F_9C_4)CHCH_2O]_{16}[(CH_2)_2O]CH_3$ | 4,268 |
| 126 | $HO[(F_3C)CHCH_2O]_5[(CH_2)_2O]C_2H_5$ | 650 |
| 127 | $HO[(F_5C_2)CHCH_2O]_9[(CH_2)_2O]C_2H_5$ | 1,548 |
| 128 | $HO[(F_7C_3)CHCH_2O]_{13}[(CH_2)_2O]C_2H_5$ | 2,846 |
| 129 | $HO[(F_9C_4)CHCH_2O]_{14}[(CH_2)_2O]C_2H_5$ | 3,758 |
| 130 | $HO[(F_3C)CHCH_2O]_6[(CH_2)_2O]C_3H_7$ | 776 |
| 131 | $HO[(F_5C_2)CHCH_2O]_{10}[(CH_2)_2O]C_3H_7$ | 1,724 |
| 132 | $HO[(F_7C_3)CHCH_2O]_{14}[(CH_2)_2O]C_3H_7$ | 3,072 |
| 133 | $HO[(F_9C_4)CHCH_2O][(CH_2)_2O]C_3H_7$ | 368 |
| 134 | $HO[(F_3C)CHCH_2O]_7[(CH_2)_2O]C_4H_9$ | 902 |
| 135 | $HO[(F_5C_2)CHCH_2O]_{11}[(CH_2)_2O]C_4H_9$ | 1,900 |
| 136 | $HO[(F_7C_3)CHCH_2O]_{15}[(CH_2)_2O]C_4H_9$ | 3,298 |
| 137 | $HO[(F_9C_4)CHCH_2O]_2[(CH_2)_2O]C_4H_9$ | 649 |
| 138 | $HO[(F_3C)CHCH_2O]_{20}[(CH_2)_2O]CH_2CF_3$ | 2,404 |
| 139 | $HO[(F_5C_2)CHCH_2O]_{23}[(CH_2)_2O]CH_2CF_3$ | 3,870 |
| 140 | $HO[(F_7C_3)CHCH_2O]_{16}[(CH_2)_2O]CH_2CF_3$ | 3,536 |
| 141 | $HO[(F_9C_4)CHCH_2O]_3[(CH_2)_2O]CH_2CF_3$ | 930 |
| 142 | $HO[(F_3C)CHCH_2O]_{21}[(CH_2)_2O]CH_2C_3F_7$ | 2,617 |
| 143 | $HO[(F_5C_2)CHCH_2O]_{22}[(CH_2)_2O]CH_2C_3F_7$ | 3,808 |
| 144 | $HO[(F_7C_3)CHCH_2O]_{15}[(CH_2)_2O]CH_2C_3F_7$ | 3,424 |
| 145 | $HO[(F_9C_4)CHCH_2O]_4[(CH_2)_2O]CH_2C_3F_7$ | 1,292 |
| 146 | $CH_3O[(F_3C)CHCH_2O]_{22}[(CH_2)_2O]CH_2CF_3$ | 2,644 |
| 147 | $CH_3O[(F_5C_2)CHCH_2O]_{21}[(CH_2)_2O]CH_2CF_3$ | 3,560 |
| 148 | $CH_3O[(F_7C_3)CHCH_2O]_{14}[(CH_2)_2O]CH_2CF_3$ | 3,126 |
| 149 | $CH_3O[(F_9C_4)CHCH_2O]_5[(CH_2)_2O]CH_2CF_3$ | 1,468 |
| 150 | $CH_3O[(F_3C)CHCH_2O]_{21}[(CH_2)_2O]CH_2CF_3$ | 2,631 |
| 151 | $CH_3O[(F_5C_2)CHCH_2O][(CH_2)_2O]CH_2CF_3$ | 420 |
| 152 | $CH_3O[(F_7C_3)CHCH_2O][(CH_2)_2O]CH_2CF_3$ | 470 |
| 153 | $CH_3O[(F_9C_4)CHCH_2O][(CH_2)_2O]CH_2CF_3$ | 520 |
| 154 | $C_2H_5O[(F_3C)CHCH_2O]_{23}[(CH_2)_2O]CH_2CF_3$ | 2,748 |
| 155 | $C_2H_5O[(F_5C_2)CHCH_2O][(CH_2)_2O]CH_2CF_3$ | 334 |
| 156 | $C_2H_5O[(F_7C_3)CHCH_2O]_{12}[(CH_2)_2O]CH_2CF_3$ | 2,716 |
| 157 | $C_2H_5O[(F_9C_4)CHCH_2O]_7[(CH_2)_2O]CH_2CF_3$ | 2,006 |
| 158 | $C_2H_5O[(F_3C)CHCH_2O]_{24}[(CH_2)_2O]CH_2CF_3$ | 2,960 |
| 159 | $C_2H_5O[(F_5C_2)CHCH_2O][(CH_2)_2O]CH_2C_3F_7$ | 435 |
| 160 | $C_2H_5O[(F_7C_3)CHCH_2O][(CH_2)_2O]CH_2C_3F_7$ | 469 |
| 161 | $C_2H_5O[(F_9C_4)CHCH_2O][(CH_2)_2O]CH_2C_3F_7$ | 563 |
| 162 | $C_3H_7O[(F_3C)CHCH_2O]_{25}[(CH_2)_2O]CH_2CF_3$ | 3,011 |
| 163 | $C_3H_7O[(F_5C_2)CHCH_2O]_{19}[(CH_2)_2O]CH_2CF_3$ | 3,264 |
| 164 | $C_3H_7O[(F_7C_3)CHCH_2O]_2[(CH_2)_2O]CH_2CF_3$ | 610 |
| 165 | $C_3H_7O[(F_9C_4)CHCH_2O][(CH_2)_2O]CH_2CF_3$ | 448 |
| 166 | $C_3H_7O[(F_3C)CHCH_2O]_{26}[(CH_2)_2O]CH_2C_3F_7$ | 3,198 |
| 167 | $C_3H_7O[(F_5C_2)CHCH_2O][(CH_2)_2O]CH_2C_3F_7$ | 449 |
| 168 | $C_3H_7O[(F_7C_3)CHCH_2O][(CH_2)_2O]CH_2C_3F_7$ | 498 |
| 169 | $C_3H_7O[(F_9C_4)CHCH_2O][(CH_2)_2O]CH_2C_3F_7$ | 548 |
| 170 | $C_4H_9O[(F_3C)CHCH_2O]_{27}[(CH_2)_2O]CH_2CF_3$ | 3,251 |
| 171 | $C_4H_9O[(F_5C_2)CHCH_2O]_6[(CH_2)_2O]CH_2CF_3$ | 1,172 |
| 172 | $C_4H_9O[(F_7C_3)CHCH_2O]_5[(CH_2)_2O]CH_2CF_3$ | 1,260 |
| 173 | $C_4H_9O[(F_9C_4)CHCH_2O][(CH_2)_2O]CH_2CF_3$ | 462 |
| 174 | $C_4H_9O[(F_3C)CHCH_2O]_{28}[(CH_2)_2O]CH_2C_3F_7$ | 3,464 |
| 175 | $C_4H_9O[(F_5C_2)CHCH_2O][(CH_2)_2O]CH_2C_3F_7$ | 486 |
| 176 | $C_4H_9O[(F_7C_3)CHCH_2O][(CH_2)_2O]CH_2C_3F_7$ | 512 |
| 177 | $C_4H_9O[(F_9C_4)CHCH_2O][(CH_2)_2O]CH_2C_3F_7$ | 562 |
| 178 | $HO[(F_3C)CHCH_2O]_{29}[(CH_2)_2O]OH$ | 3,326 |
| 179 | $HO[(F_5C_2)CHCH_2O]_3[(CH_2)_2O]OH$ | 564 |
| 180 | $HO[(F_7C_3)CHCH_2O]_3[(CH_2)_2O]OH$ | 502 |
| 181 | $HO[(F_9C_4)CHCH_2O][(CH_2)_2O]OH$ | 340 |
| 182 | $CH_3O[(F_3C)CHCH_2O]_4[(CH_2)_2O]CH_3$ | 538 |
| 183 | $CH_3O[(F_5C_2)CHCH_2O]_5[(CH_2)_2O]CH_3$ | 900 |
| 184 | $CH_3O[(F_7C_3)CHCH_2O]_6[(CH_2)_2O]CH_3$ | 1,362 |
| 185 | $CH_3O[(F_9C_4)CHCH_2O]_7[(CH_2)_2O]CH_3$ | 1,924 |
| 186 | $C_2H_5O[(F_3C)CHCH_2O]_8[(CH_2)_2O]C_2H_5$ | 1,014 |
| 187 | $C_2H_5O[(F_5C_2)CHCH_2O]_9[(CH_2)_2O]C_2H_5$ | 1,576 |
| 188 | $C_2H_5O[(F_7C_3)CHCH_2O]_{10}[(CH_2)_2O]C_2H_5$ | 2,238 |
| 189 | $C_2H_5O[(F_9C_4)CHCH_2O]_{11}[(CH_2)_2O]C_2H_5$ | 3,000 |
| 190 | $C_3H_7O[(F_3C)CHCH_2O]_{12}[(CH_2)_2O]C_3H_7$ | 1,490 |
| 191 | $C_3H_7O[(F_5C_2)CHCH_2O]_{13}[(CH_2)_2O]C_3H_7$ | 2,252 |
| 192 | $C_3H_7O[(F_7C_3)CHCH_2O]_{14}[(CH_2)_2O]C_3H_7$ | 3,114 |
| 193 | $C_3H_7O[(F_9C_4)CHCH_2O]_{14}[(CH_2)_2O]C_3H_7$ | 3,814 |
| 194 | $C_4H_9O[(F_3C)CHCH_2O]_{16}[(CH_2)_2O]C_4H_9$ | 1,966 |
| 195 | $C_4H_9O[(F_5C_2)CHCH_2O]_{17}[(CH_2)_2O]C_4H_9$ | 2,928 |
| 196 | $C_4H_9O[(F_7C_3)CHCH_2O]_{18}[(CH_2)_2O]C_4H_9$ | 3,990 |
| 197 | $C_4H_9O[(F_9C_4)CHCH_2O]_{12}[(CH_2)_2O]C_4H_9$ | 3,318 |
| 198 | $CH_3O[(F_3C)CHCH_2O]_{20}[(CH_2)_2O]C_2H_5$ | 2,344 |

-continued

| | | |
|---|---|---|
| 199 | $CH_3O[(F_5C_2)CHCH_2O]_{21}[(CH_2)_2O]C_2H_5$ | 3,506 |
| 200 | $CH_3O[(F_7C_3)CHCH_2O]_{15}[(CH_2)_2O]C_2H_5$ | 3,284 |
| 201 | $CH_3O[(F_9C_4)CHCH_2O]_{10}[(CH_2)_2O]C_2H_5$ | 2,724 |
| 202 | $CH_3O[(F_3C)CHCH_2O]_{24}[(CH_2)_2O]C_3H_7$ | 2,806 |
| 203 | $CH_3O[(F_5C_2)CHCH_2O]_{23}[(CH_2)_2O]C_3H_7$ | 3,844 |
| 204 | $CH_3O[(F_7C_3)CHCH_2O]_{14}[(CH_2)_2O]C_3H_7$ | 3,086 |
| 205 | $CH_3O[(F_9C_4)CHCH_2O]_9[(CH_2)_2O]C_3H_7$ | 2,476 |
| 206 | $CH_3O[(F_3C)CHCH_2O]_{28}[(CH_2)_2O]C_4H_9$ | 3,268 |
| 207 | $CH_3O[(F_5C_2)CHCH_2O]_{20}[(CH_2)_2O]C_4H_9$ | 3,372 |
| 208 | $CH_3O[(F_7C_3)CHCH_2O]_{13}[(CH_2)_2O]C_4H_9$ | 2,888 |
| 209 | $CH_3O[(F_9C_4)CHCH_2O]_8[(CH_2)_2O]C_4H_9$ | 2,228 |
| 210 | $C_2H_5O[(F_3C)CHCH_2O]_{32}[(CH_2)_2O]C_3H_7$ | 3,716 |
| 211 | $C_2H_5O[(F_5C_2)CHCH_2O]_{19}[(CH_2)_2O]C_3H_7$ | 3,210 |
| 212 | $C_2H_5O[(F_7C_3)CHCH_2O]_{12}[(CH_2)_2O]C_3H_7$ | 1,965 |
| 213 | $C_2H_5O[(F_9C_4)CHCH_2O]_7[(CH_2)_2O]C_3H_7$ | 1,965 |
| 214 | $C_2H_5O[(F_3C)CHCH_2O]_{30}[(CH_2)_2O]C_4H_9$ | 3,506 |
| 215 | $C_2H_5O[(F_5C_2)CHCH_2O]_{18}[(CH_2)_2O]C_4H_9$ | 3,055 |
| 216 | $C_2H_5O[(F_7C_3)CHCH_2O]_{11}[(CH_2)_2O]C_4H_9$ | 2,478 |
| 217 | $C_2H_5O[(F_9C_4)CHCH_2O]_6[(CH_2)_2O]C_4H_9$ | 1,718 |
| 218 | $C_3H_7O[(F_3C)CHCH_2O]_{29}[(CH_2)_2O]C_4H_9$ | 3,408 |
| 219 | $C_3H_7O[(F_5C_2)CHCH_2O]_{17}[(CH_2)_2O]C_4H_9$ | 2,914 |
| 220 | $C_3H_7O[(F_7C_3)CHCH_2O]_{10}[(CH_2)_2O]C_4H_9$ | 1,470 |
| 221 | $C_3H_7O[(F_9C_4)CHCH_2O]_5[(CH_2)_2O]C_4H_9$ | 1,470 |
| 222 | $F_3CH_2CO[(F_3C)CHCH_2O]_7[(CH_2)_2O]CH_2CF_3$ | 1,010 |
| 223 | $F_3CH_2CO[(F_5C_2)CHCH_2O][(CH_2)_2O]CH_2CF_3$ | 388 |
| 224 | $F_3CH_2CO[(F_7C_3)CHCH_2O][(CH_2)_2O]CH_2CF_3$ | 413 |
| 225 | $F_3CH_2CO[(F_9C_4)CHCH_2O]_7[(CH_2)_2O]CH_2CF_3$ | 488 |

Having described the invention in detail and by reference to preferred embodiments thereof, it will be apparent that modifications and variations are possible without departing from the scope of the invention defined in the appended claims.

What is claimed is:

1. A composition for use in compression refrigeration and air-conditioning comprising:

(a) at least one refrigerant selected from the group consisting of hydrofluorocarbon, hydrochlorofluorocarbon, fluorocarbon, and chlorofluorocarbon; and (b) a sufficient amount to provide lubrication of at least one polyoxyalkylene glycol wherein said polyoxyalkylene glycol has a molecular weight between about 300 and about 4,000 has a viscosity of about 5 to about 300 centistokes at 37° C., and has at least one pendant non-terminal perfluorinated alkyl group.

2. The composition of claim 1 wherein said polyoxyalkylene glycol is prepared by reacting a partially fluorinated epoxy alkane.

3. The composition of claim 1 wherein in addition to said at least one pendant non-terminal perfluorinated alkyl group on the hydrocarbon polymer backbone, said polyoxyalkylene glycol has pendant non-terminal alkyl groups on said hydrocarbon polymer backbone.

4. The composition of claim 1 wherein said refrigerant is a hydrofluorocarbon.

5. The composition of claim 4 wherein said hydrofluorocarbon is tetrafluoroethane.

6. The composition of claim 5 wherein said tetrafluoroethane is 1,1,1,2-tetrafluoroethane.

7. The composition of claim 3 wherein of the total number of pendant, non-terminal perfluorinated alkyl groups and pendant, non-terminal alkyl groups in said polyoxyalkylene glycol, at least 40% are pendant, non-terminal perfluorinated alkyl groups.

8. The composition of claim 1 wherein the polyoxyalkylene glycol is miscible in combination with the refrigerant in the range between −40° C. and at least +20° C.

9. The composition of claim 1 wherein said polyoxyalkylene glycol is of the formula $$R'O-[(R_f)CH-CH_2-O]_m[RCHCH_2O]_nR'$$

wherein R' is selected from the group consisting of hydrogen, alkyl, or fluoroalkyl; m is 2 to 40; n is 0 to 60; R is selected from the group consisting of hydrogen and alkyl group; and $R_f$ is a perfluoroalkyl group.

10. The composition of claim 9 wherein at least one R' is hydrogen.

11. The composition of claim 9 wherein at least one R' is an alkyl group having 1 to 12 carbon atoms.

12. The composition of claim 9 wherein at least one R' is a fluoroalkyl group of the formula $$-(CH_2)_x(CF_2)_yCF_3$$

wherein x is 1 to 4 and y is 0 to 15.

13. The composition of claim 8 wherein $R_f$ is a perfluoroalkyl group selected from the group consisting of perfluoromethyl, perfluoroethyl, perfluoropropyl, perfluorobutyl, perfluoropentyl, perfluorohexyl, perfluoroheptyl, and perfluorooctyl.

14. The composition of claim 10 wherein said polyoxyalkylene glycol is of the formula $$HO-[(R_f)CH-CH_2-O]_m[RCHCH_2O]_nH$$

wherein m is 4 to 40 and n=40−m.

15. The composition of claim 11 wherein said polyoxyalkylene glycol is of the formula $$CH_3O-[(R_f)CH-CH_2-O]_m[RCHCH_2O]_nCH_3$$

wherein m is 4 to 40 and n=40−m.

16. The composition of claim 12 wherein said polyoxyalkylene glycol is of the formula $$CF_3CH_2)-[(R_f)CH-CH_2-O]_m[RCHCH_2O]_nCH_2CF_3$$

wherein m is 4 to 40 and n=40−m.

17. The composition of claim 12 wherein said polyoxyalkylene glycol is of the formula $$F_7C_3CH_2O[(R_f)CHCH_2O]_m[RCHCH_2O]_nCH_2C_3F_7$$

wherein m is 4 to 40 and n=40−m.

18. The composition of claim 10 wherein said polyoxyalkylene glycol is of the formula $$HO-[(R_f)CH-CH_2-O]_m[RCHCH_2O]_nH$$

wherein the ratio of m to n is at least 2:3.

19. The composition of claim 11 wherein said polyoxyalkylene glycol is of the formula $$CH_3O-[(R_f)CH-CH_2-O]_m[RCHCH_2O]_nCH_3$$

wherein the ratio of m to n is at least 2:3.

20. The composition of claim 12 wherein said polyoxyalkylene glycol is of the formula $$CF_3CH_2O[(R_f)CHCH_2O]_m[RCHCH_2O]_nCH_2CF_3$$

wherein the ratio of m to n is at least 2:3.

21. The composition of claim 12 wherein said polyoxyalkylene glycol is of the formula $$F_7C_3CH_2O[(R_f)CHCH_2O]_m[RCHCH_2O]_nCH_2C_3F_7$$

wherein the ratio of m to n is at least 2:3.

22. A method for improving lubrication in compression refrigeration and air-conditioning equipment using a refrigerant selected from the group consisting of hydrofluorocarbon, hydrochlorofluorocarbon, fluorocarbon, and chlorofluorocarbon comprising the step of:

employing as a lubricant at least one polyoxyalkylene glycol wherein said polyoxyalkylene glycol has a molecular weight between about 300 and 4,000, has a viscosity of about 5 to about 300 centistokes at 37° C., and has at least one pendant non-terminal perfluorinated alkyl group.

23. The method of claim 22 wherein said polyoxyalkylene glycol is of the formula $$R'O[(R_f)CHCH_2O]_m[RCHCH_2O]_nR'$$

wherein R' is selected from the group consisting of hydrogen, alkyl, or fluoroalkyl; m is 2 to 40; n is 0 to 60; $R_f$ is a perfluoroalkyl group; and R is selected from the group consisting of hydrogen and alkyl group.

* * * * *